US005795450A

United States Patent [19]

Hirai et al.

[11] Patent Number: 5,795,450

[45] Date of Patent: Aug. 18, 1998

[54] APPARATUS FOR PRODUCING HYDROGEN AND OXYGEN

[75] Inventors: Kiyoshi Hirai, Kakogawa; Shinichi Yasui, Kako-gun; Hiroko Kobayashi, Kobe; Mamoru Nagao, Osaka; Takashi Sasaki, Miki; Hiroyuki Harada, Tokyo, all of Japan

[73] Assignee: Shinko Pantec Co., Ltd., Hyogo, Japan

[21] Appl. No.: 811,263

[22] Filed: Mar. 4, 1997

[51] Int. Cl.[6] ..... C25B 9/00; C25B 15/08

[52] U.S. Cl. ..... 204/256; 204/258

[58] Field of Search ..... 204/254–256, 204/257–258

[56] References Cited

U.S. PATENT DOCUMENTS

| | | | |
|---|---|---|---|
| 4,358,357 | 11/1982 | Pere | 204/256 |
| 4,758,322 | 7/1988 | Sioli | 204/254 X |
| 4,975,171 | 12/1990 | Nishiki et al. | 204/256 X |
| 5,015,354 | 5/1991 | Nishiki et al. | 204/256 X |
| 5,112,463 | 5/1992 | Zhang et al. | 204/256 X |

FOREIGN PATENT DOCUMENTS

| | | | |
|---|---|---|---|
| 63-502908 | 10/1988 | Japan | C25B 9/00 |
| 06003328 A | 1/1994 | Japan | G01N 27/72 |

OTHER PUBLICATIONS

Hanizumi, *Electric Chemical Manual*, issued by The Electric Chemical Society of Japan, pp. 732–735 (1981); translation of p. 733, lines 8–21. (No Month).

*Primary Examiner*—Donald R. Valentine

*Attorney, Agent, or Firm*—Marshall, O'Toole, Gerstein, Murray & Borun

[57] ABSTRACT

A simple and efficient apparatus for producing hydrogen and oxygen is disclosed, wherein resistance to the flow of deionized water, oxygen gas, and hydrogen gas does not increase, and the amount of electric energy required for electrolysis can be reduced. A bipolar-type apparatus for producing hydrogen and oxygen, wherein a main water feeding path is formed in the approximate center of electrode plates in the axial direction, and an anode chamber and a cathode chamber are formed on opposing surfaces of the electrode plates to store porous conductors. A secondary water feeding path for the anode chamber directs water from the main water feeding path to the anode chamber. On the cathode side of the apparatus, a hydrogen gas collecting chamber is formed, a plurality of radial hydrogen gas paths are formed from the cathode chamber to the hydrogen gas collecting chamber, and a hydrogen gas discharging path are formed to axially hydrogen gas collecting chambers in each electrode plate. On the anode side of the apparatus, an oxygen gas path is formed from the anode chamber to the oxygen gas collecting chamber, and an oxygen gas discharging path is formed to axially connect to the oxygen gas collecting chambers in each electrode plate.

3 Claims, 11 Drawing Sheets

APPARATUS FOR PRODUCING HYDROGEN AND OXYGEN

BACKGROUND OF THE INVENTION

1. Field of the Invention

The present invention relates to an apparatus for producing hydrogen and oxygen wherein solid electrolyte membranes are used as diaphragms, such that when deionized water is fed to the anode side of the membrane, electrolysis generates oxygen gas from the anode side of the membrane and hydrogen gas from the cathode side of the membrane.

2. Description of Related Art

With respect to the construction of an apparatus for producing hydrogen and oxygen, a so-called "bipolar filter press type electrolyzer," as disclosed in Shinpan Denki-Kagaku Binran (Electrochemical Manual, the Latest Version), compiled by Denkikagaku Kyokai, published by Maruzen, 2nd version, 4th print, page 733), such as the prior art apparatus illustrated in FIG. 10, has been proposed for large-scale facilities that require large volumes of oxygen gas and hydrogen gas.

The apparatus illustrated in FIG. 10 comprises a plurality of solid electrolyte membrane units 120. The membrane units 120 are joined together, and each solid electrolyte membrane unit 120 comprises a solid electrolyte membrane 110, for example, a cation exchange membrane, such as, a fluorocarbon resin cation exchange membrane, like NAFION 117, available from E. I. DuPont deNemours, Wilmington, Del., meshy porous conductors 111 and 112 manufactured from, for example, a metal in the platinum group and being positioned on opposing surfaces of solid electrolyte membrane 10, and bipolar-type electrode plates 113, which are positioned to contact porous conductors 111 and 112. A bipolar-type electrode plate 113 is a single electrode plate with opposing faces that have an opposite polarity when energized.

In this case, when water is fed to the anode side of the electrolyte membrane unit, electrolysis is effected. As a result, on the anode side, a reaction $22H_2O \rightarrow O_2+4H^++4e^-$ occurs to generate oxygen gas. On the cathode side, a reaction $4H^++4e^- \rightarrow 2H_2$ occurs to generate hydrogen gas.

The apparatus has a construction such that deionized water feeding paths 115 are provided to feed deionized water to porous conductors 111 on the anode side of solid electrolyte membrane units 120. Oxygen gas discharging paths 116 are provided to discharge oxygen gas (including water) from porous conductors 111 on the anode side of solid electrolyte membrane units 120, and hydrogen discharging paths 117 are provided to discharge hydrogen gas (including water) from porous conductors 112 on the cathode side of solid electrolyte membrane units 120.

In the "bipolar filter press-type electrolyzer" described above, deionized water and oxygen generated on the anode side of the units flow from water feeding paths 115 provided at one end of the anode side of porous conductors 111 in the direction of oxygen gas discharging paths 116 provided at the opposite end of porous conductors 111.

Furthermore, normally speaking, the form of porous conductors 111 is disc-like, hence, as shown in FIG. 11, the sectional area of the flow path for deionized water and oxygen gas increases (indicated by the arrows in FIG. 11) first, and then, near the outlet side, the sectional area decreases near the oxygen gas discharging paths 116, thereby increasing the resistance to flow. This phenomenon also occurs on the cathode side of the unit. The increase in flow resistance results in an increase in the amount of electric energy required for electrolysis, and a decrease of the overall efficiency of the apparatus.

As means for solving these problems, as disclosed in Japanese Patent Laid Open Publication (National Publication of Translation/KOHYO) No. SHO 63-502908 and Japanese Patent Laid Open Publication (KOKAI) No. HEI 06-033283, apparatus for producing hydrogen and oxygen have been disclosed wherein the apparatus is arranged in a way such that a water feeding path is provided axially in the center of the apparatus for producing hydrogen and oxygen. The water and hydrogen generated from the cathode plate are discharged through a path provided axially in the periphery of the apparatus, and the oxygen and water generated from the anode plate are discharged through a jacket provided axially between a cylindrical housing (casing) and the outer circumferential part of the cell.

However, because prior art apparatus for producing hydrogen and oxygen require a jacket for discharging oxygen and water, such apparatus has a complicated design, such as including a casing, sealing elements, and a jacket.

SUMMARY OF THE INVENTION

In consideration of the problems encountered using prior art apparatus, the present invention provides a simple and efficient apparatus for producing hydrogen and oxygen wherein resistance against the flow of deionized water, oxygen gas, and hydrogen gas is not increased, the amount of electric energy required for electrolysis can be reduced to a minimum, and the conventional complicated arrangement used to overcome increased flow resistance, such as a casing, sealing elements, and a jacket, is not required.

The present invention solves the problems presented by prior art apparatus, and accomplishes the objectives mentioned above as set forth in the following paragraphs (1) through (3).

(1) A bipolar-type apparatus for producing hydrogen and oxygen comprising a plurality of joined solid electrolyte membrane units, wherein each solid electrolyte membrane unit comprises a solid electrolyte membrane, a porous conductor in contact with each of two opposing surfaces of the solid electrolyte membrane, and an electrode plate positioned to contact each porous conductor, wherein the electrode plate has the capability of performing the functions of an anode and a cathode, a main water feeding path for feeding water, and preferably deionized water, to the solid electrolyte membrane units in the axial direction thereof, a cathode chamber and an anode chamber separated from one another by each of the electrode plates, each chamber containing a porous conductor, a secondary water feeding path for the anode chamber being formed in each of the electrode plates from the main water feeding path to the anode chamber, a hydrogen gas collecting chamber and a hydrogen gas path from the cathode chamber to the hydrogen gas collecting chamber being formed in each electrode plate in a radially outer portion thereof, a hydrogen gas discharging path being formed to axially connect with the hydrogen gas collecting chambers formed in the electrode plates, an oxygen gas collecting chamber and an oxygen gas path from the anode chamber to the oxygen gas collecting chamber being formed in each electrode plate in a radially outer portion thereof, and an oxygen gas discharging path being formed to axially connect with the oxygen gas collecting chambers formed in the electrode plates.

(2) An apparatus for producing hydrogen and oxygen described in (1) above wherein the solid electrolyte membrane is a solid polymer electrolyte membrane.

(3) An apparatus for producing hydrogen and oxygen described in (1) or (2) above wherein the water feeding path is at, or near, the center of each solid electrolyte membrane unit.

An apparatus for producing hydrogen and oxygen according to the present invention exhibits the following novel and unexpected features.

(1) Because deionized water is fed from the center into each anode chamber, wherein the distance between electrode plates and said electrolyte membrane is kept constant, deionized water can flow towards the radially outward side. Hence, deionized water flows radially toward the outward side, or outer circumferential portion, with a decreasing velocity. On the other hand, as oxygen gas generated by the solid electrolyte membrane on the anode side flows into an anode chamber having a cross section which increases in the flow direction, towards the outer circumference, the resistance to flow becomes very low. Therefore, the resistance to flow decreases, the electrolytic potential required for electrolysis decreases, and, in turn, the electric energy required for electrolysis decreases. As a result, the efficiency of the present apparatus is very high. This effect also applies to the cathode side of the apparatus.

(2) Because the anode chamber is provided on the lower side of the electrode plate, the deionized water flows into the lower portion of the anode chamber, namely in the solid electrolyte membrane side, owing to the gravity thereof, and the generated oxygen gas is separated from the deionized water and flows above the deionized water, namely the electrode plate side. Therefore, the electrolyte membrane always is in contact with deionized water. This prevents interruption of the water supply, which has an adverse effect on the useful life of a solid polymer electrolyte membrane.

(3) Because the anode side of each electrode plate is provided with oxygen gas paths, an oxygen gas collecting chamber, and an oxygen gas discharging path, and the cathode side of the electrode plate is provided with hydrogen gas paths, a hydrogen gas collecting chamber, and a hydrogen gas discharging path to discharge oxygen gas and hydrogen gas, respectively, the conventional complicated prior art apparatus construction, which required a casing, sealing elements, and jacket, is not required. Thus, a simple and efficient apparatus for producing hydrogen and oxygen is provided.

(4) Because the solid electrolyte membrane of the present invention has a construction wherein electrodes of a precious metal or metals are bonded by chemical plating onto opposing surfaces of a solid polymer electrolyte, water is not present between the solid polymer electrolyte and either electrode. Hence, there is neither solution resistance nor gas resistance, and in turn, contact resistance between the solid polymer electrolyte and both electrodes is low, the voltage is low, and current distribution is even. As a result, it is possible to use a higher current density and electrolyze water at a higher temperature and higher pressure, resulting in the production of high purity oxygen and hydrogen gases with a greater efficiency.

DESCRIPTION OF THE PREFERRED EMBODIMENTS

In the following, embodiments of the present invention are described in detail with reference to the attached drawings.

Figure 1:
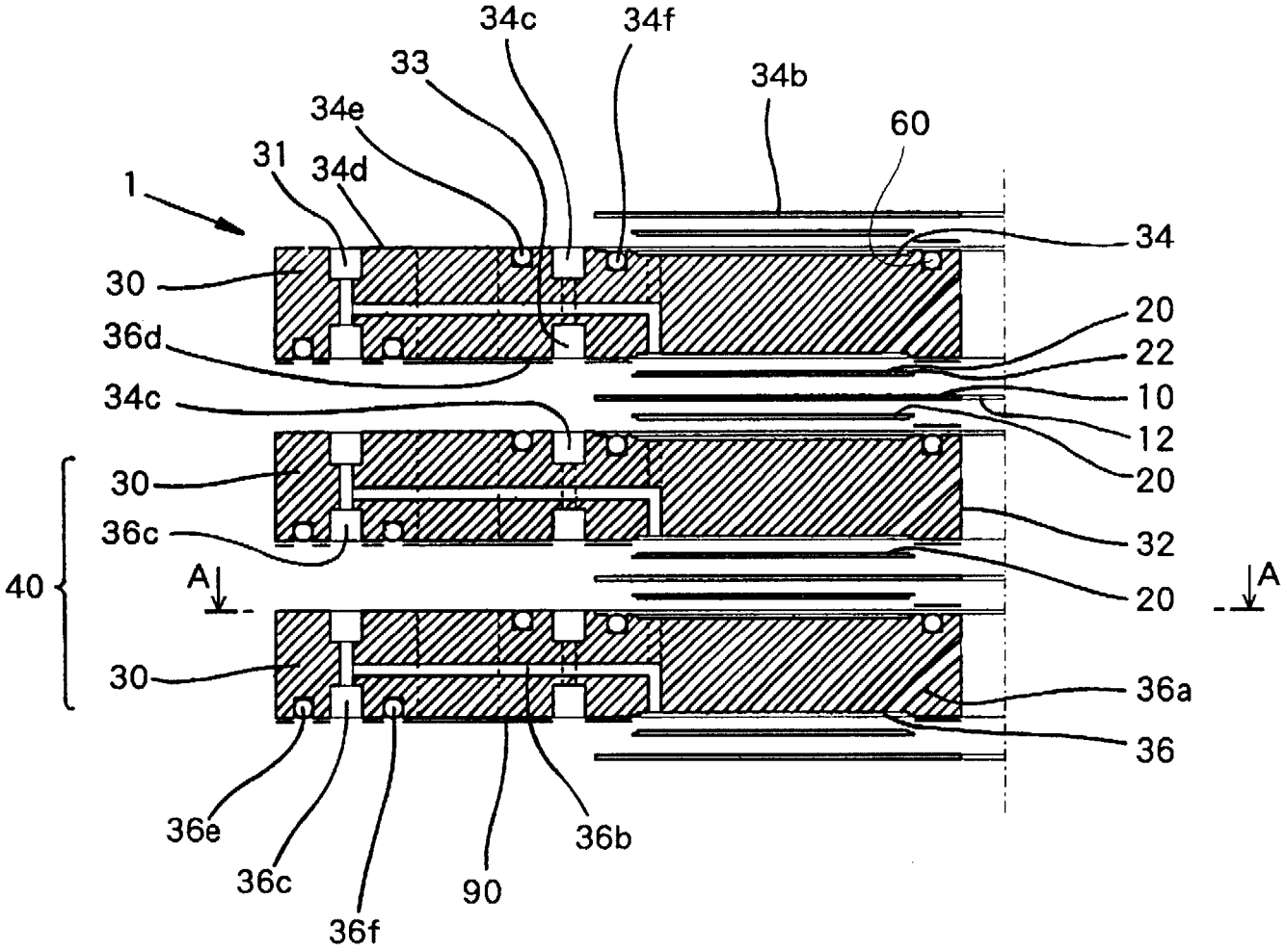
FIG. 1 is a partial longitudinal sectional view of an embodiment of an apparatus for producing hydrogen and oxygen according to the present invention, showing only one side relative to the central axis thereof, and corresponds to a longitudinal sectional view along the line A3–A3' of FIG. 2.
Figure 2:
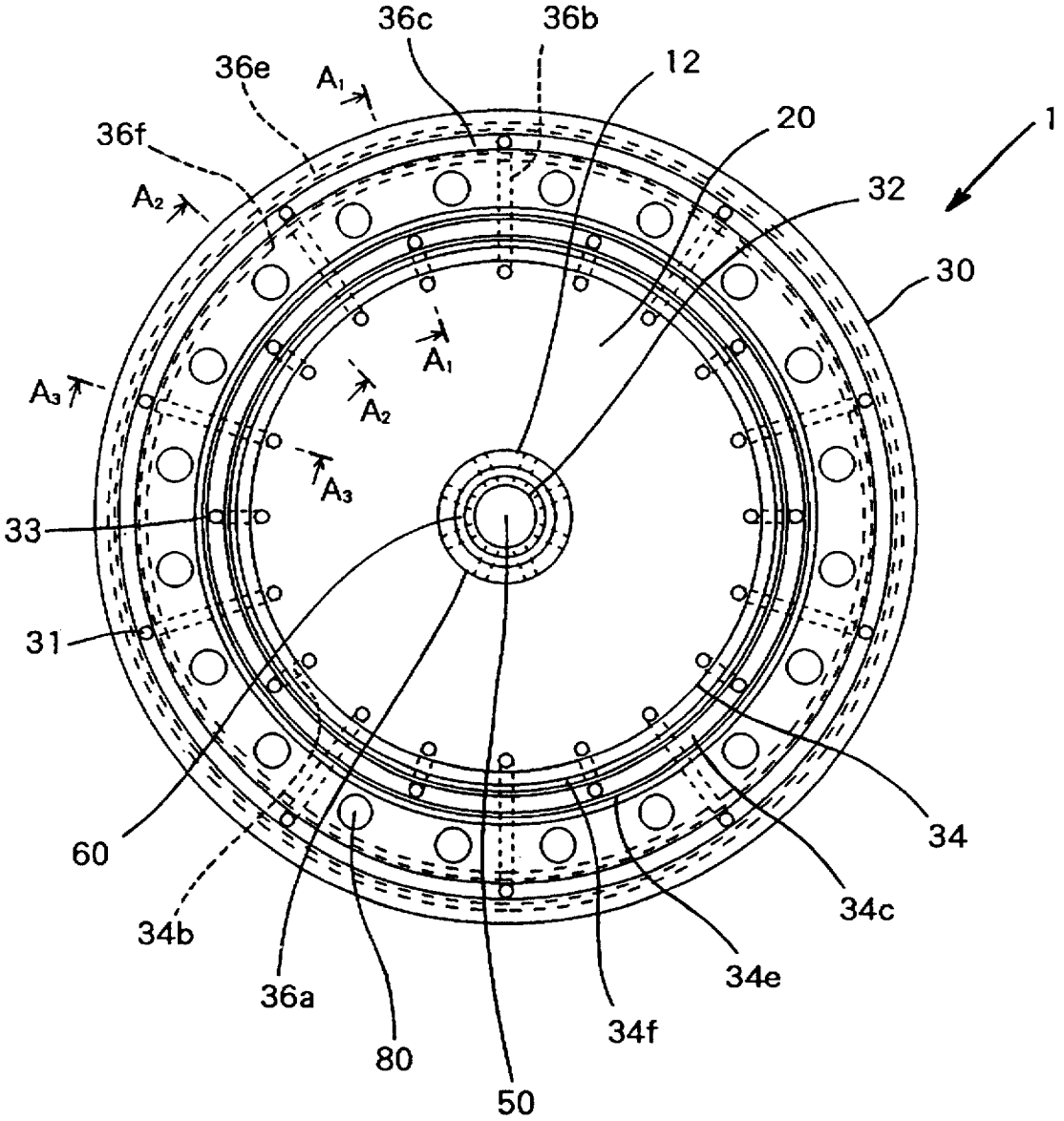
FIG. 2 is a sectional view along the line A—A of FIG. 1.
Figure 3:
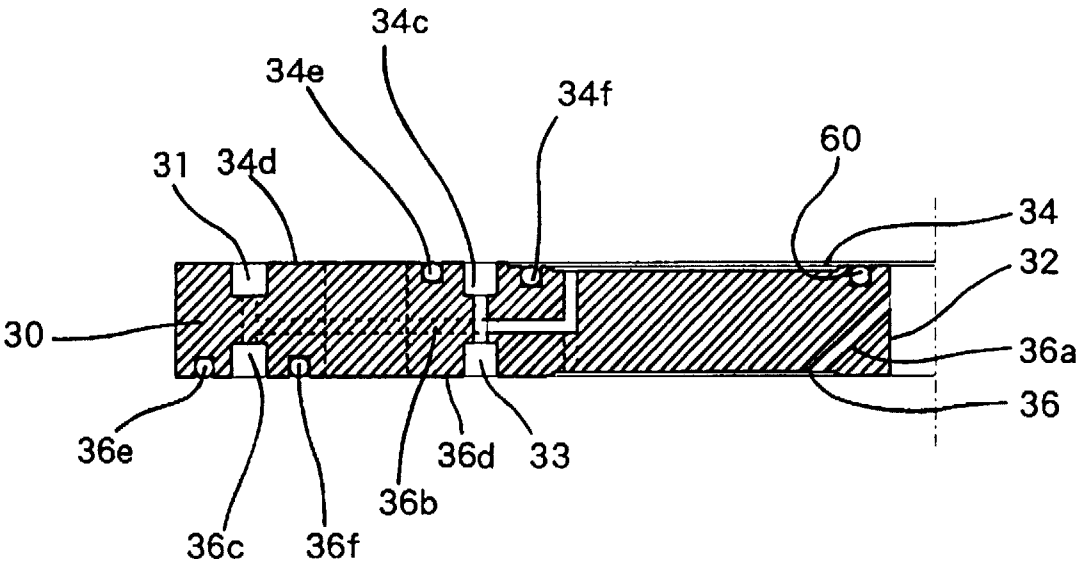
FIG. 3 is a partial longitudinal sectional view along the line A1—A1 of FIG. 2.
Figure 4:
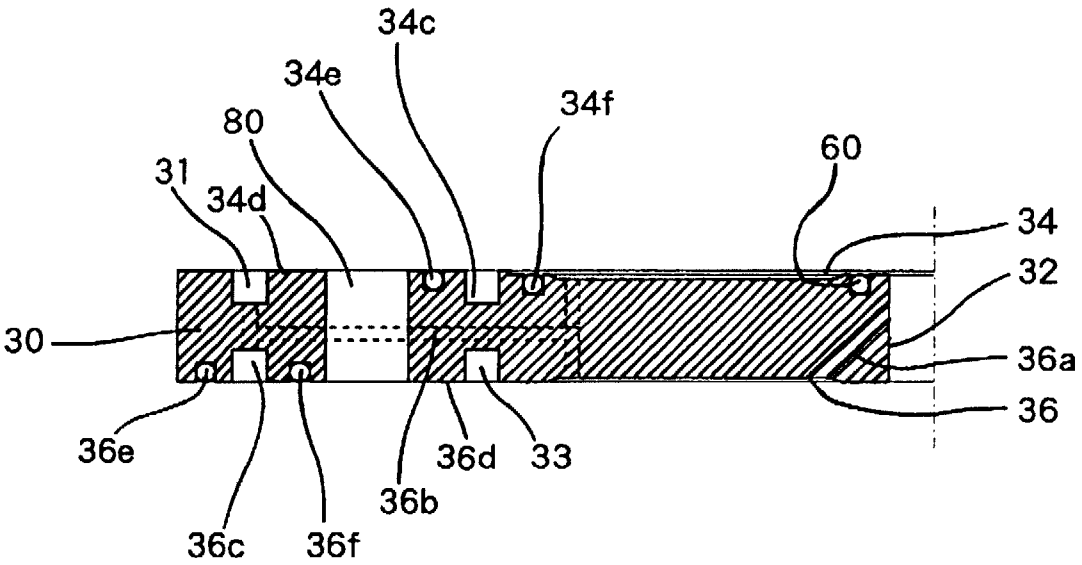
FIG. 4 is a partial longitudinal sectional view along the line A2—A2 of FIG. 2.
Figure 5:
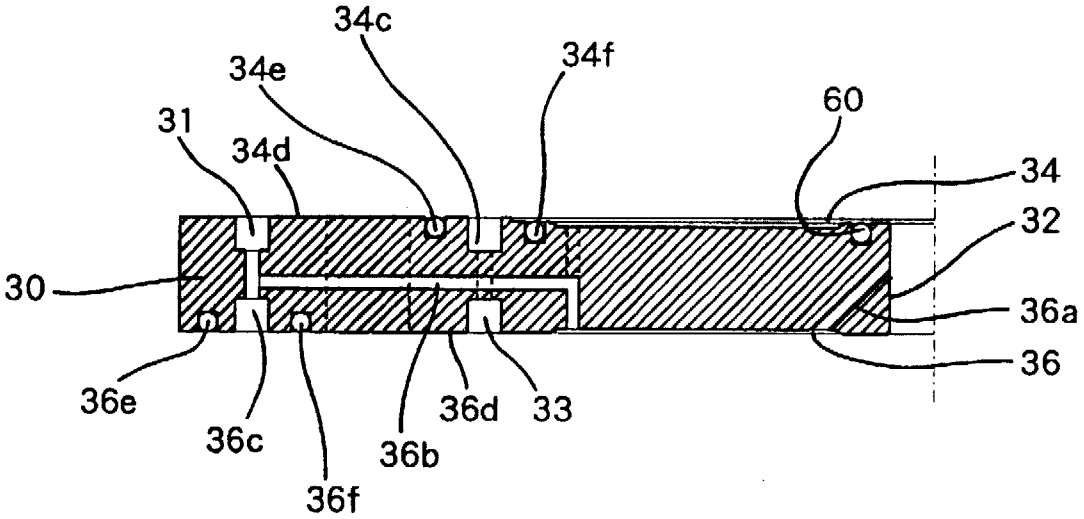
FIG. 5 is a partial longitudinal sectional view along the line A3—A3 of FIG. 2.

FIG. 1 is a partial longitudinal sectional view of an embodiment of the present invention, and, more particularly, is a longitudinal sectional view showing only one side of the apparatus relative to the central axis thereof. FIG. 1 corresponds to the longitudinal sectional view along the line A3—A3 of FIG. 2. FIG. 2 is a sectional view along the line A—A of FIG. 1. FIG. 3 is a partial longitudinal sectional view along the line A1—A1 of FIG. 2. FIG. 4 is a partial longitudinal sectional view along the line A2—A2 of FIG. 2. FIG. 5 is a partial longitudinal sectional view along the line A3—A3 of FIG. 2.

In FIG. 1 and FIG. 2, the numeral 1 denotes the entirety of an apparatus for producing hydrogen and oxygen according to the present invention. Apparatus 1 for producing hydrogen and oxygen basically has a construction wherein a plurality of annular solid electrolyte membrane units 40 are joined together. Each annular solid electrolyte membrane unit 40 comprises an annular solid electrolyte membrane 10, annular porous conductors 20 in contact with each opposing surface of membrane 10, and annular electrode plates 30, each electrode plate 30 capable of performing both the functions of an annular anode and an annular cathode, and being positioned adjacent to, and in contact with, porous conductors 20. Apparatus 1 for producing hydrogen and oxygen preferably is used, as shown in FIG. 1, with solid electrolyte membrane units 40 being joined vertically, but apparatus 1 can be rotated by 90 degrees from the above-mentioned vertical position into a horizontal position.

A main water feeding path 50 (see FIG. 2) is provided at or near the center of respective solid electrolyte membrane units 40 in the axial direction thereof, and water feeding path 50 extends through a center hole 32 of electrode plate 30, center holes 22 of porous conductors 20, and a center hole 12 of solid electrolyte membrane 10. An O-ring-shaped sealing member 60 is provided around center hole 32 on the top side of electrode plate 30 to isolate a cathode chamber 34 from main water feeding path 50.

Each electrode plate 30, except both end electrode plates of the apparatus, is a bipolar-type electrode plate, which is a single electrode plate having opposing surfaces that have opposite potentials when energized. On the cathode side (the bottom side in FIG. 1) thereof, an annular-dent-shaped anode chamber 36 is formed on the radially outer side relative to water feeding path 50, and porous conductor 20 of the anode side is positioned in anode chamber 36. On the other hand, on the cathode side (the top side in FIG. 1) thereof, an annular-dent-shaped cathode chamber 34 is formed on the radially outer side relative to main water feeding path 50, and porous conductor 20 of the cathode side is positioned in cathode chamber 34.

Each electrode plate 30 is provided, as shown in FIG. 1, FIG. 2, and FIG. 5, with a plurality of secondary water feeding paths **36*a* for the anode chambers that are positioned radially from the inner circumferential wall of center hole 32 of electrode plate 30 to connect main water feeding path 50 and anode chamber 36. Moreover, a plurality of roughly U-shaped oxygen gas paths 36*b* are radially provided on the radially outer side of anode chamber 36, and the terminals of the paths 36*b* are connected to an annular oxygen gas collecting chamber 36*c* formed on the cathode side surface of electrode plate 30 near the peripheral surface thereof. In this case, oxygen gas collecting chamber 36*c* comprises annular grooves formed on an end face 36*d* of electrode plate 30 and on an end face 36*d* of a second electrode plate 30 adjacent to electrode plate 30, respectively, and two sealing members 36*e* and 36*f*, e.g., O-rings, are provided around oxygen gas collecting chamber 36*c* to seal chamber 36*c* so that water and generated oxygen gas do not leak from chamber 36*c*. Oxygen gas collecting chambers 36*c* provided in respective electrode plates 30 are connected to each other via an oxygen gas discharging path 31 bored axially through electrode plate 30 in a position staggered away from secondary water feeding paths 36*a* for the anode chambers in terms of the central angle (please refer to FIG. 1, FIG. 2 and FIG. 5**).

In this case, in the present embodiment, secondary water feeding paths **36*a* are provided in the position of the cross section along A3—A3 of FIG. 2, but the position is not limited to this cross section; paths 36*a* can be provided, for example, in the A1—A1 cross section or the A2—A2 cross section of FIG. 2**.

On the other hand, each electrode plate 30 is provided, as shown in FIG. 1, FIG. 2 and FIG. 3, with a plurality of roughly U-shaped hydrogen gas paths **34*b* that are provided radially on the inner circumference of cathode chamber 34, hydrogen gas paths 34*b* are staggered away from the above-mentioned secondary water feeding paths 36*a* for anode chamber in terms of the central angle. The terminals of hydrogen gas paths 34*b* are connected to an annular-dent-shaped hydrogen gas collecting chamber 34*c* formed on the anode side face of electrode plate 30 near the peripheral surface thereof. In this case, hydrogen gas collecting chamber 34*c* comprises annular grooves formed on one end face 34*d* of electrode plate 30 and on one end face 34*d* of a second electrode plate 30 adjacent to electrode plate 30. Two sealing members 34*e* and 34*f*, e.g., O-rings, are provided around hydrogen gas collecting chamber 34*c* to seal chamber 34*c* such that water and generated hydrogen gas do not leak from hydrogen gas collecting chamber 34*c*. Hydrogen gas collecting chambers 34*c* provided in respective electrode plates 30 are connected to each other via a hydrogen gas discharging path 33 bored axially through electrode plate 30 in a position staggered away from hydrogen gas paths 34*b* in terms of the central angle to axially penetrate hydrogen gas collecting chambers 34*c***.

The various above-mentioned paths can be bored in electrode plates 30 by means of drills, or similar equipment. In addition, it is possible to use electric discharge machining or casting.

With respect to the present embodiment illustrated in FIG. 1, oxygen gas collecting chamber **36*c* is located in a radially more outer position than hydrogen gas collecting chamber 34*c*. Conversely, hydrogen gas collecting chamber 34*c* can be located in a radially more outer position than oxygen gas collecting chamber 36*c*. Moreover, in the case of the present embodiment, the number of secondary water feeding paths 36*a* for anode chambers and the number of oxygen gas paths 34*b*** are ten each. These numbers, however, can be modified suitably. Further, in the present embodiment, the electrode plates, porous conductors, solid electrolyte membranes, and other elements, are annular, but the elements are not limited to this form. The main water feeding path is passed through the center of the solid electrolyte units, but the feeding path is not limited to this position.

As for solid electrolyte membrane 10, a solid polymer electrolyte is suitable to be formed into a membrane, for example, a solid polymer electrolyte membrane, wherein a porous anode and a porous cathode, each of a precious metal, and particularly a metal of the platinum group, are bonded by chemical plating onto opposing faces of a cation exchange membrane, such as a cation exchange membrane made of fluorocarbon resin containing sulphonic acid groups, for example, NAFION 117, available from DuPont deNemours, Inc., Wilmington, Del. In this case, both electrodes preferably are made of platinum. In particular, when both electrodes are of a two-layer construction of platinum and iridium, it is possible to electrolyze using a high current density, for example, at 80° C. and 200 A/dm2, for as long as about four years, whereas a conventional solid electrolyte in which the electrodes are in physical contact with an ion exchange membrane can be electrolyzed at 50 to 70 A/dm2. In this case, in addition to the abovementioned iridium, it is possible to use a solid polymer electrolyte membrane of a multi-layer construction wherein two or more metals of the platinum group are plated. It is possible to achieve operation at a high current density by using above-mentioned membrane.

When solid electrolyte membrane 10 of the present application is constructed such that electrodes of a precious metal or metals are bonded by chemical plating onto opposing faces of solid polymer electrolyte 10, water is not present between the solid polymer electrolyte and either electrode. Hence, there is neither solution resistance nor gas resistance, and in turn, contact resistance between the solid polymer electrolyte and each electrode is low, the voltage is low, and current distribution is even. As a result, it is possible to use higher current density and electrolyze water at a higher temperature and at higher pressure, which results in production of high purity oxygen and hydrogen gases with a greater efficiency.

In accordance with the present embodiment, the diameter of solid polymer electrolyte membrane 10 preferably is about 280 mm. As shown in FIG. 1, solid polymer electrolyte membrane 10 extends to sealing member 34f of oxygen gas collecting chamber 34c. Accordingly, membrane 10 is sealed such that hydrogen gas and oxygen gas generated on opposite sides of membrane 10 do not mix together.

On the other hand, with respect to porous conductor 20, it is preferable to use a mesh of titanium, for example, three plies of expanded metal of a few millimeters in total thickness. When using such porous conductors, it is possible to feed electric current required for electrolysis from electrode plates 30 to platinum-plated portions on the surfaces of solid electrolyte membrane 10, while deionized water, being the raw material, and generated oxygen and hydrogen gases are allowed to pass through the porous conductors. In short, porous conductor 20 can be any porous material that is conductive, permeable to air, and corrosion resistant. In addition to the above-mentioned materials, it is possible to use porous carbon materials, porous metallic materials, porous and conductive ceramics, and similar materials for porous conductor 20.

With respect to electrode plate 30, when a metal is used as the material of construction therefor, titanium can be used to prevent elution of metallic ions into the deionized water, and the thickness of electrode plate 30 can be from several millimeters to several tens of millimeters. When the dimensions of O-ring grooves are taken into consideration, electrode plate 30 preferably has a thickness of about 20 mm. In addition to titanium, the material of construction of electrode plate 30 can be graphite. In this case, the dimensions of the graphite electrode plate preferably are identical to those of an electrode plate made of titanium.

Figure 6:
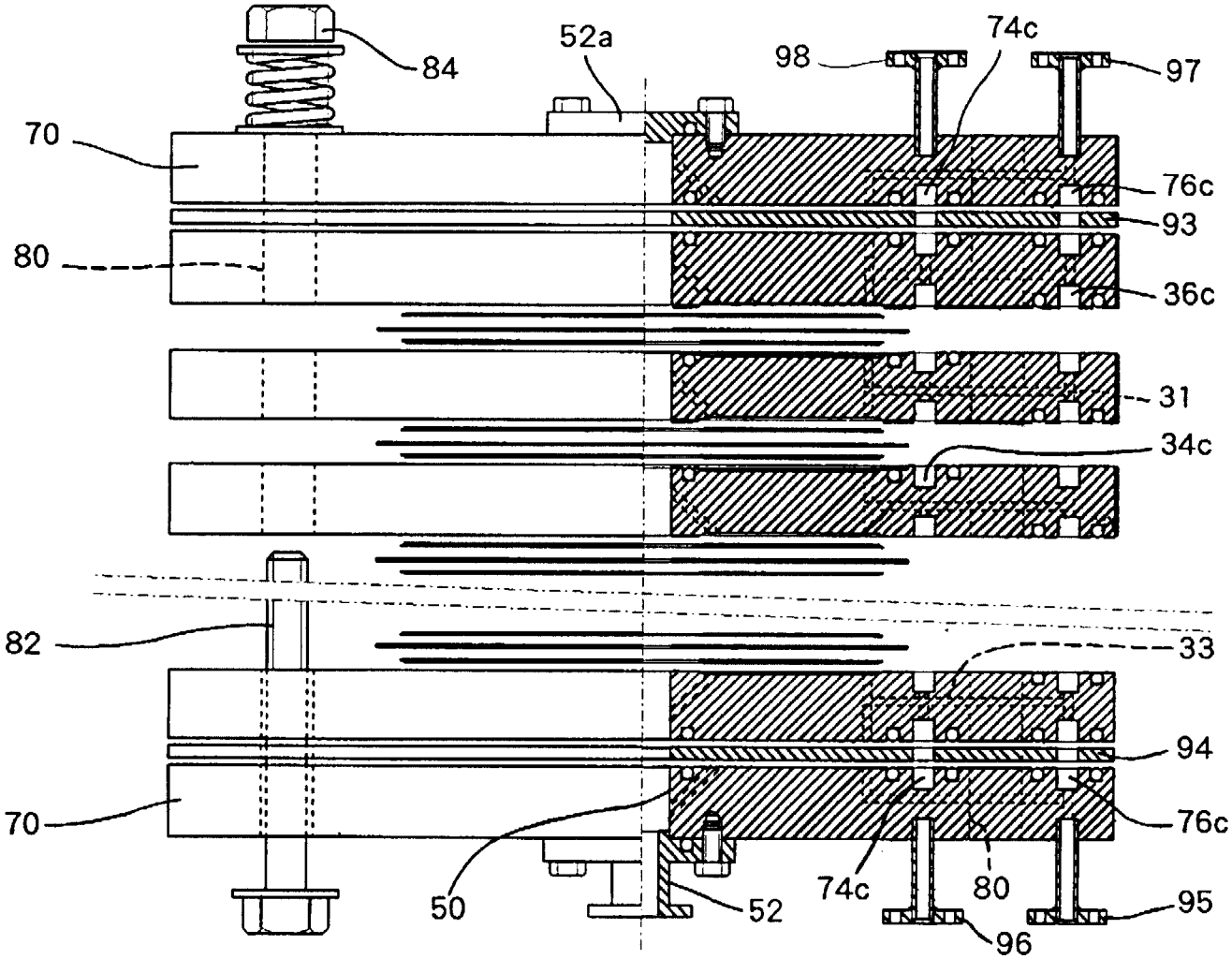
FIG. 6 is a partial longitudinal sectional view illustrating an apparatus for producing hydrogen and oxygen according to the present invention wherein solid electrolyte membrane units are arranged in a row and clamped together.
Figure 7:
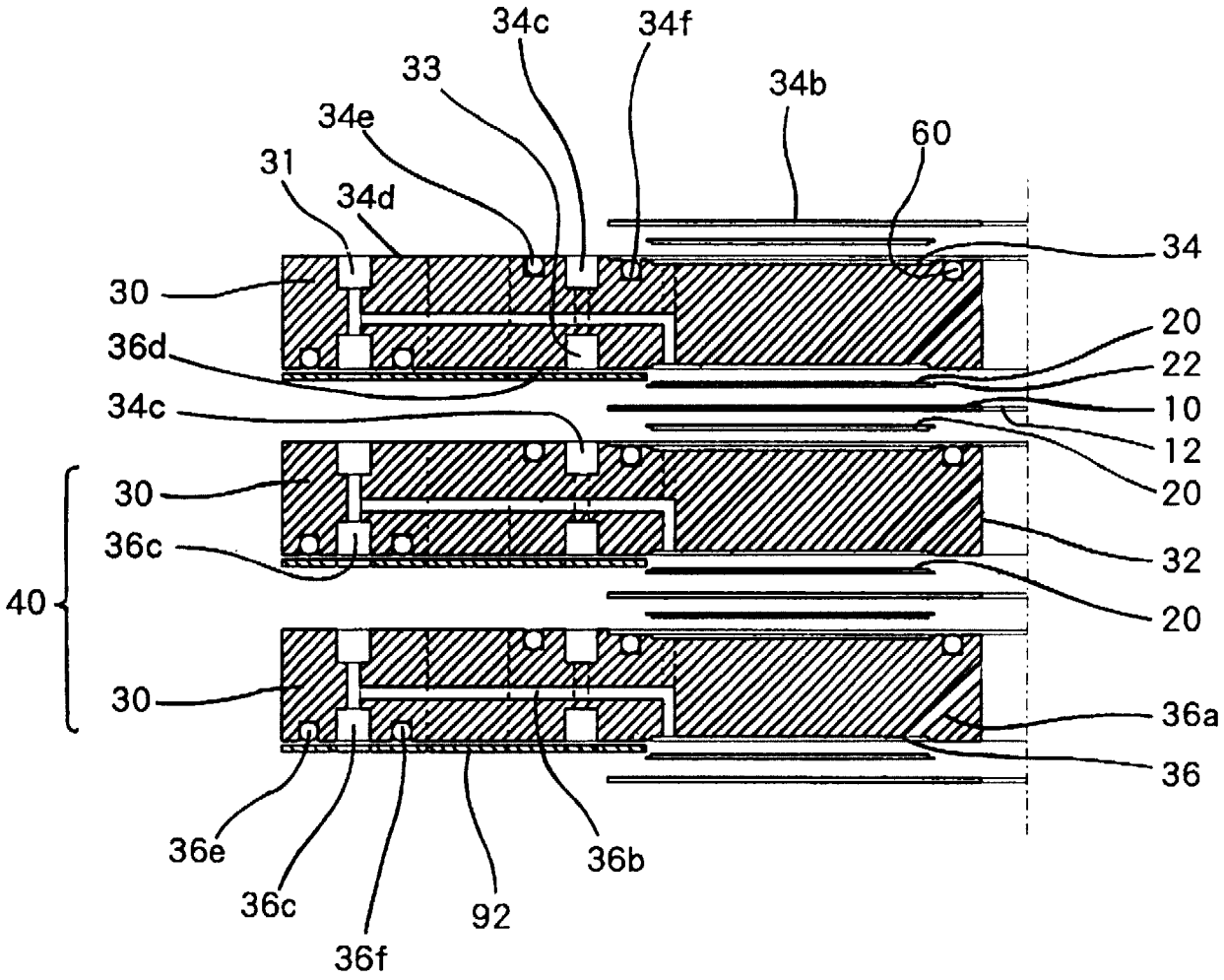
FIG. 7 is a partial enlarged sectional view of FIG. 1, showing the annular insulating spacers positioned between electrode plates.

When solid electrolyte membrane units 40 are arranged in a row and clamped together, as shown in FIG. 6, disc-like end plates 70 made of a stainless steel, such as SUS304 or SUS316, are positioned outside solid electrolyte membrane units 40 located at each end, and when solid electrolyte membrane units 40 are arranged in a row, the respective members can be clamped by providing an insulating coating 90 of polytetrafluoroethylene (PTFE) or a similar coating (please refer to FIG. 1) or an annular insulating spacer 92 (please refer to FIG. 7) to insulate the respective electrode plates, providing additional insulating spacers 93 and 94 between end plates 70 at each end and the electrode plates at each end, making a plurality of through holes 80 extending between the end plates 70 at both ends of apparatus 1 for producing hydrogen and oxygen, inserting bolts 82 through through holes 80, and tightening bolts 82 with nuts 84.

In this case, as shown in FIG. 6, one end plate 70 (on the lower side in FIG. 6) is provided, at the center thereof, with a flange-type water feeding port 52 that connects to main water feeding paths 50, and with a flange-type water drain port 95 on the oxygen side that connects to oxygen gas discharging paths 31 and oxygen gas collecting chambers 36c, and a flange-type water drain port 96 on the hydrogen side that connects to hydrogen gas discharging paths 33 and hydrogen gas collecting chambers 34c. In this case, end plate 70 is provided, on the inner face thereof, with an annular oxygen gas collecting chamber 76c and an annular hydrogen gas collecting chamber 74c that correspond to oxygen gas collecting chamber 36c and hydrogen gas collecting chamber 34c.

Moreover, the other end plate 70 (on the upper side in FIG. 6) is provided with a flange-type oxygen gas discharging port 97 that connects to oxygen gas discharging path 31 and oxygen gas collecting chamber 36c, and a flange-type hydrogen gas discharging port 98 that connects to hydrogen gas discharging path 33 and hydrogen gas collecting chamber 34c. The other end plate 70 (on the upper side in FIG. 6) also is provided with a closing cover 52a to close the other end of main water feeding path 50, namely, secondary water feeding path 36a for anode chamber of the end plate 70 on the opposite side of water feeding port 52.

As for water drain port 95 on the oxygen side, water drain port 96 on the hydrogen side, oxygen gas discharging port 97, and hydrogen gas discharging port 98, one or two or more of each can be provided at appropriate intervals in the circumferential direction.

Figure 8:
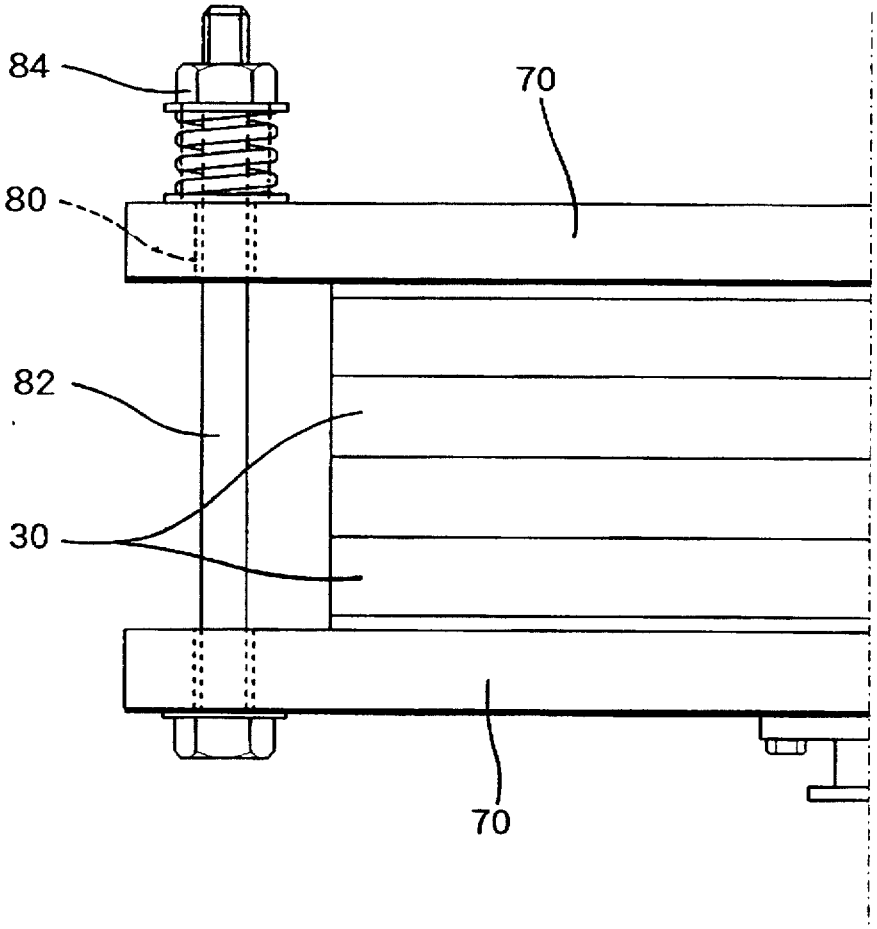
FIG. 8 is a partial longitudinal sectional view illustrating another embodiment of the apparatus for producing hydrogen and oxygen according to the present invention wherein solid electrolyte membrane units are arranged in a row and clamped together.

FIG. 8 is a partial sectional view showing another embodiment wherein the above-mentioned solid electrolyte membrane units 40 are arranged in a row and clamped together. The construction is such that the diameter of end plates 70 on each end is greater than the diameter of electrodes 30, a plurality of through holes 80 are made in the protruding sections of end plates 70, through bolts 82 are put through holes 80 and through bolts 82 are tightened by nuts 84. This eliminates the need for making through holes for bolt clamping in electrode plates 30, insulating spacers 93 and 94 and other elements, thereby resulting in easier fabrication.

Electrode plates 30 positioned at each end of apparatus 1 for producing hydrogen and oxygen are provided with a projection protruding outwardly from the periphery thereof, although not illustrated. Thus, electric current can be fed to said projections.

Figure 9:
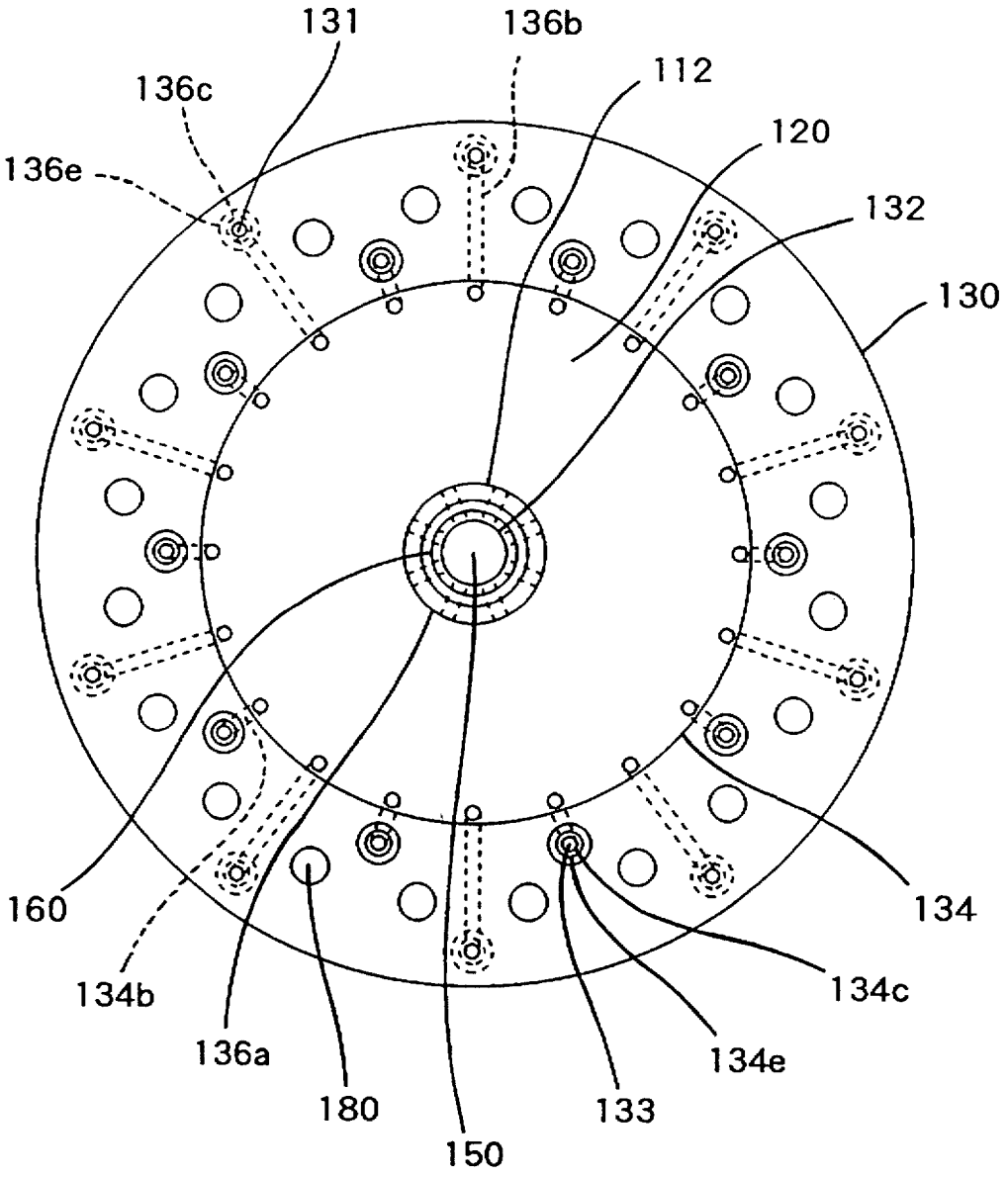
FIG. 9 is a sectional view of another embodiment of the apparatus for producing hydrogen and oxygen according to the present invention, and is similar to FIG. 2.
Figure 10:
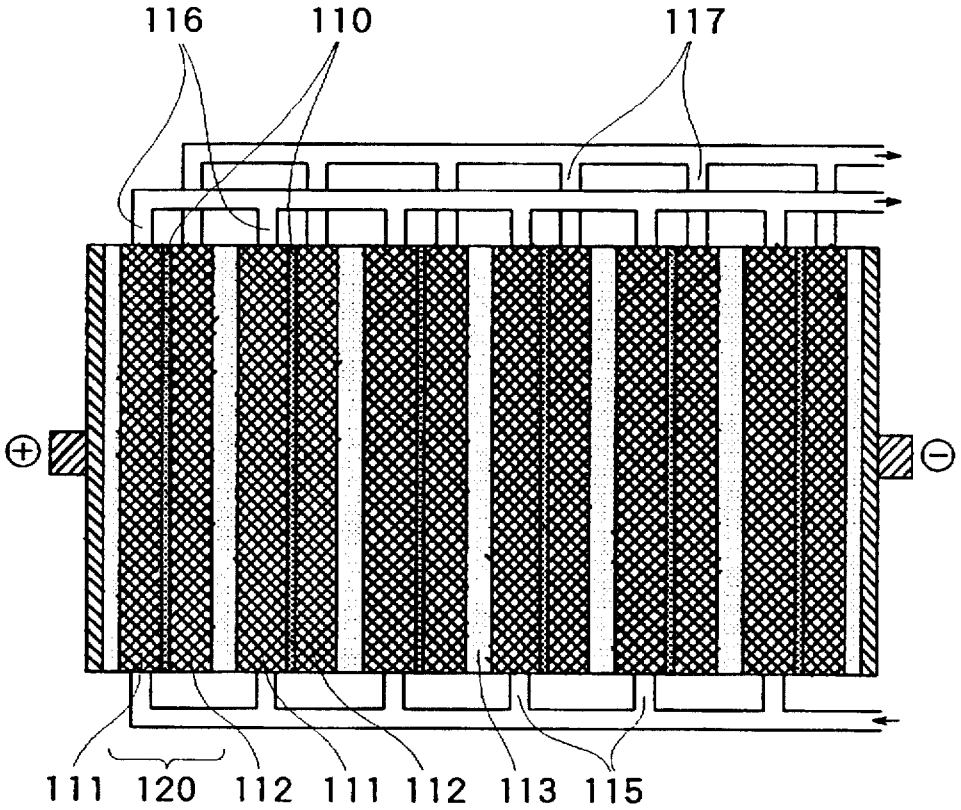
Prior Art Fig.10
FIG. 10 is a sectional view schematically showing a conventional prior art double-electrode filter press-type apparatus for producing hydrogen and oxygen.
Figure 11:
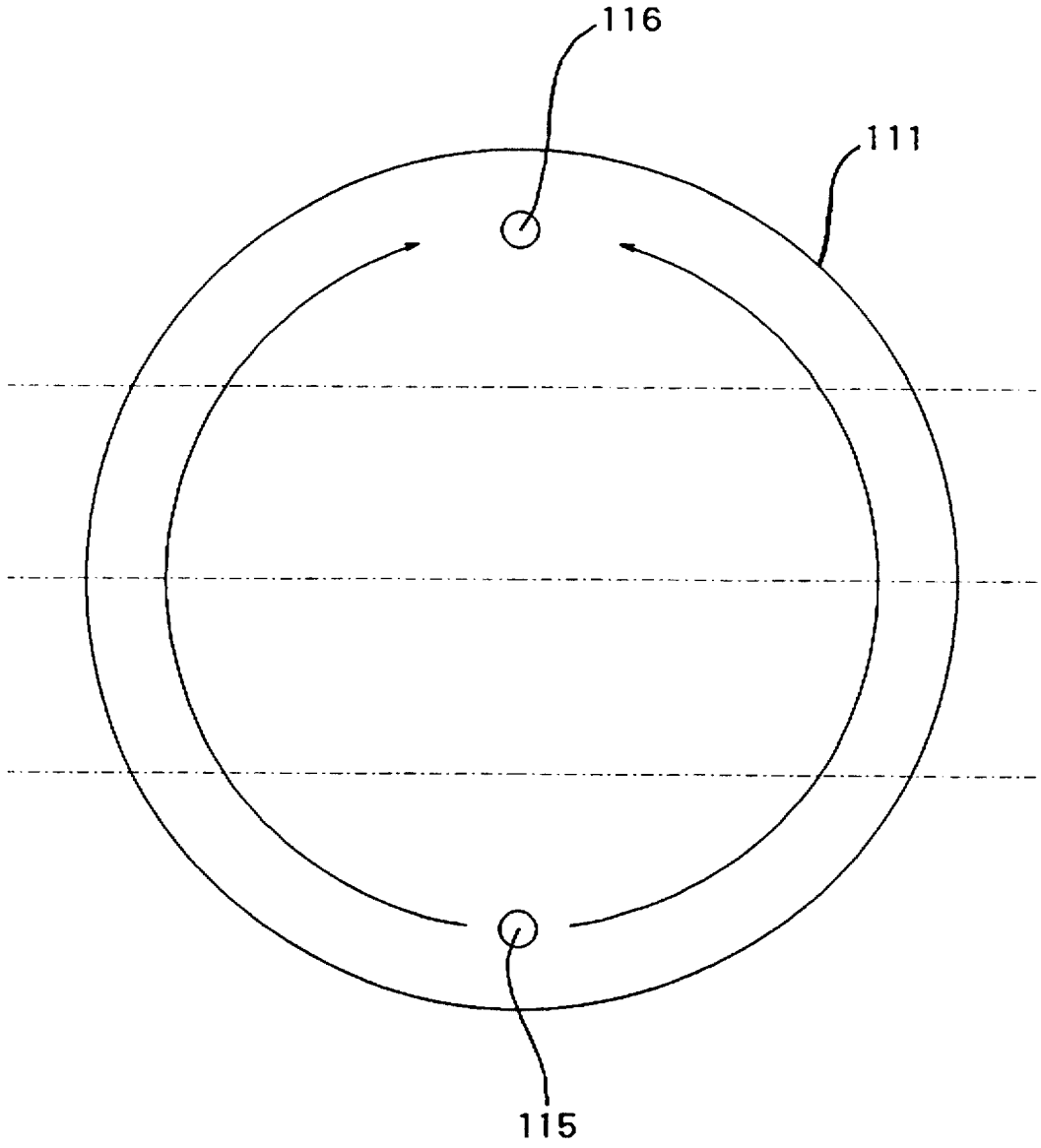
Prior Art Fig.11
FIG. 11 is a schematic diagram showing the flow of water and gases in a conventional prior art double-electrode filter press-type apparatus for producing hydrogen and oxygen.

FIG. 9 is a sectional view of another embodiment of an apparatus for producing hydrogen and oxygen according to the present invention, and is similar to FIG. 2. Elements of FIG. 9 corresponding to elements of the above-discussed embodiment in FIG. 2 are identified by reference numbers wherein 100 is added to the original reference numbers of FIG. 2. The embodiment in FIG. 9 differs from the embodiment in FIG. 2 in that oxygen gas collecting chambers 136c are not annular. The oxygen gas collecting chambers are independent cylindrical oxygen gas collecting chambers 136c for the respective units, and an O-ring 136e is provided around each oxygen gas collecting chamber 136c to seal an oxygen gas discharging path 131. Similarly, hydrogen gas collecting chambers 134c are not annular. The hydrogen gas collecting chambers are independent cylindrical hydrogen gas collecting chambers 134c for the respective units, and an O-ring 134e is provided around each hydrogen gas collecting chamber 134c to seal a hydrogen gas discharging path 133. In this case, although not illustrated, an annular oxygen gas collecting chamber and an annular hydrogen gas collecting chamber can be formed in the end plate to discharge oxygen gas and hydrogen gas from the plurality of gas collecting chambers through a single oxygen gas discharging port and a single hydrogen gas discharging port, respectively. This eliminates the need of providing many discharging ports, resulting in a simpler construction.

In the above-described apparatus 1 for producing hydrogen and oxygen according of the present invention, first, deionized water flows from a deionized water feeding system (not illustrated), through main water feeding path 50, and via center hole 12 of each solid electrolyte membrane 10, to the radially outward portion of porous conductor 20 in each anode chamber 36. This is to feed deionized water to each solid electrolyte membrane 10.

Deionized water is electrolyzed by solid electrolyte membrane 10 on the anode side. A reaction $2H_2O \rightarrow O_2 + 4H^+ + 4e^-$ occurs to generate oxygen gas. Water and the generated oxygen gas are discharged via the oxygen gas paths 36b, oxygen gas collecting chamber 36*c*, and oxygen gas discharging path 31, and oxygen gas is separated from the water by a gas-liquid separator (not illustrated) connected to the oxygen gas discharging path 31.

On the other hand, on the cathode side, $H^+$ passes through the solid electrolyte membrane 10, and $H^+$ is supplied with electrons on the cathode side. A reaction $4H^++4e^-2H_2$ occurs to generate hydrogen gas, and water and the generated hydrogen gas are discharged via the hydrogen gas paths 34*b*, hydrogen gas collecting chamber 34*c*, and hydrogen gas discharging path 33, and hydrogen gas is separated from the water by a gas-liquid separator (not illustrated) connected to hydrogen gas discharging path 33. In this case, in each electrode plate 30, deionized water from main water feeding path 50 is fed into anode chamber 36 for electrolysis, via a plurality of deionized water feeding paths 36*a* radially formed from the inner circumferential wall of center hole 32 of electrode plate 30.

What is claimed is:

1. A bipolar apparatus for producing hydrogen and oxygen comprising a plurality of joined solid electrolyte membrane units, each solid electrolyte membrane unit comprising a solid electrolyte membrane having two opposing surfaces, a porous conductor in contact with each opposing surface of the solid electrolyte membrane, and an electrode plate in contact with each porous conductor, wherein each electrode plate performs as an anode and a cathode, a main water feeding path formed through the solid electrolyte membrane units in the axial direction thereof, a cathode chamber and an anode chamber separated from one another by each of the electrode plates, wherein each chamber stores the porous conductor, a secondary water feeding path for the anode chamber formed in each electrode plate from the main water feeding path to the anode chamber, a hydrogen gas collecting chamber and a hydrogen gas path, said hydrogen gas path extending from the cathode chamber to the hydrogen gas collecting chamber and formed in each electrode plate in a radially outer portion thereof, a hydrogen gas discharging path extending axially to hydrogen gas collecting chambers formed in the electrode plates, an oxygen gas collecting chamber and an oxygen gas path, said oxygen gas path extending from the anode chamber to the oxygen gas collecting chamber and formed in each electrode plate in a radially outer portion thereof, and an oxygen gas discharging path extending axially to the oxygen gas collecting chambers formed in the electrode plates.

2. The apparatus of claim 1 wherein the solid electrolyte membrane is a solid polymer electrolyte membrane.

3. The apparatus of claim 1 wherein the main water feeding path is formed at or near the center of each solid electrolyte membrane unit.

* * * * *

UNITED STATES PATENT AND TRADEMARK OFFICE

CERTIFICATE OF CORRECTION

PATENT NO. : 5,795,450

DATED : August 18, 1998

INVENTOR(S) : Hirai et al.

It is certified that error appears in the above-identified patent and that said Letters Patent is hereby corrected as shown below:

Column 1, line 40, "$22H_2O \rightarrow O_2+4H^++4e^-$" should be -- $2H_2O \rightarrow O_2+4H^++4e^-$ --

Column 6, line 47, "abovementioned" should be -- above-mentioned --

Column 9, line 7, "$4H^++4e^-2H_2$" should be -- $4H^++4e^- \rightarrow 2H_2$ --

Signed and Sealed this

Fifth Day of October, 1999

*Attest:*

*Attesting Officer*

Q. TODD DICKINSON

*Acting Commissioner of Patents and Trademarks*